United States Patent [19]

Toth

[11] Patent Number: 4,925,368

[45] **Date of Patent: * May 15, 1990**

[54] TURBO-COMPRESSOR HAVING AIR-COOLED BEARING

[75] Inventor: Denis W. Toth, Pontiac, Mich.

[73] Assignee: Can-Am Engineered Products, Inc., Livonia, Mich.

[ * ] Notice: The portion of the term of this patent subsequent to Mar. 8, 2005 has been disclaimed.

[21] Appl. No.: 208,590

[22] Filed: Jun. 20, 1988

Related U.S. Application Data

[63] Continuation-in-part of Ser. No. 67,305, Jun. 29, 1987, Pat. No. 4,780,056.

[51] Int. Cl.[5] ..... F04B 39/00; F04D 29/04

[52] U.S. Cl. ..... 415/180; 417/312; 417/362; 415/199.1

[58] Field of Search ..... 415/199.1, 199.2, 199.3, 415/180; 417/362, 423.12, , 423 H, 366

[56] References Cited

U.S. PATENT DOCUMENTS

| | | | |
|---|---|---|---|
| 3,145,913 | 8/1964 | Dolz | 415/199.3 X |
| 3,224,667 | 12/1965 | Strike et al. | 415/199.3 |
| 3,289,923 | 12/1966 | Millman | 415/199.3 |
| 3,320,895 | 5/1967 | Peterson et al. | 417/362 X* |
| 4,729,722 | 3/1988 | Toth | 415/119 |
| 4,780,056 | 10/1988 | Toth | 415/180 |

FOREIGN PATENT DOCUMENTS

| | | | |
|---|---|---|---|
| 165198 | 10/1958 | Sweden | 417/362 |
| 1492644 | 11/1977 | United Kingdom | 417/362 |

*Primary Examiner*—Robert E. Garrett

*Assistant Examiner*—Hoang Nguyen

*Attorney, Agent, or Firm*—Arnold S. Weintraub; Gerald R. Black

[57] ABSTRACT

The turbo-compressor air supply system of the present invention supplies air to a paint spray system or the like at an elevated pressure. The turbo-compressor includes a housing and a rotatable, vertically-disposed drive shaft centrally disposed within the housing, and a bearing housing which houses a concentrically disposed bearing. The system comprises a rotatable section centrally disposed about the shaft. The section includes a first rotor and a second rotor. Each rotor comprises a first series of blades spirally arrayed about the center of the shaft. The first series of blades are sandwiched between a first pair of plates. The rotors are rotatably driven in the same direction as the shaft, as air is directed onto and through the blades. The rotors are coaxial with the shaft. The rotatable section also includes a tubular sleeve which is mounted about the shaft. The sleeve separates the rotors, and the sleeve is rotatable with the rotors and the shaft in the same direction as the rotors and the shaft. The turbo-compressor also includes a stationary section, which is centrally disposed about the shaft. The stationary section includes a stator, which comprises a series of vanes spirally arrayed around the center of the central passage. The vanes are sandwiched between a pair of stator plates. The stator is coaxial with the shaft. For variations including more than one stator, the stators are each separated by a ring which is mounted between successive stators. The air is fed into the top of the turbo-compressor and exits through the bottom thereof.

10 Claims, 2 Drawing Sheets

TURBO-COMPRESSOR HAVING AIR-COOLED BEARING

CROSS REFERENCE TO RELATED APPLICATIONS

This is a Continuation-In-Part of patent application Ser. No. #067,305 entitled by Denis W. Toth, which was filed on June 27, 1987, in the United States Patent Office.

BACKGROUND OF THE INVENTION

1. Field of the Invention

The present invention relates to the field of multi-stage turbo-compressors, and more particularly, to a portable turbo-compressor which supplies pressurized air to a paint spray system or the like.

2. Background Art

Industrial spray painting systems are commercially available, wherein a turbo-compressor and drive motor are mounted on a cart and transported as a unit to the article to be painted. In these units, the motor and the turbo-compressor are mounted adjacent to each other upon a horizontal plate which constitutes the cart.

One of these units is described in U.S. patent application Ser. No. #067,305 entitled "Turbo-Compressor Havisng Air-Cooled Bearing", by Dennis W. Toth, which was filed on June 27, 1987, and which is incorporated by reference herein. The motor shaft and turbine shaft extend vertically downward through their respective housings and the mounting plate, and are coupled to each other by a drive belt located below the mounting plate. The electric drive-motor is mounted with the drive shaft disposed vertically and projecting downwardly through an opening in the housing. Rotation of the shaft of the drive motor is transmitted to the shaft of the turbo-compressor by an encased belt and a pulley drive. The turbo-compressor has multiple stages with the final stage being located at the bottom of the compressor. The chamber which encloses the final stage is defined by the bottom of the compressor housing, through which the drive shaft extends. The high speed rotation of the drive shaft causes a continuous and relatively high rate of flow compressed air from the final stage of the turbo-compressor.

There is a continuous and high rate of compressed air flowing through a restricted orifice opening into the chamber below the mounting place. The high speed rotation of the drive shaft does not tightly seal this opening, but this air flow generates a high noise level. Additional noise is generated at the intake to the turbo-compressor. U.S. Pat. #4,729,722 entitled "Noise Suppressor for Turbo-Compressor" by Dennis W. Toth, which is incorporated by reference herein, describes an apparatus for suppressing this noise.

SUMMARY OF THE INVENTION

What is needed is a new configuration employing the basic principles of fluid dynamics to operate the aforementioned paint spray air supply system. A centrifugal turbo-compressor delivers air at high pressures by drawing air into the center of the casing. A rotor attached to a rotatable shaft, may be driven by an electric motor. The rotor may contain a number of blades arranged in a spiral pattern. When circulated flowing through these blades, the air is given an acceleration and emerges under pressure from the spiral casing. The air is directed through to the rotor blades by an annular, stationary stator. The stator has a number of vanes spaced and shaped to distribute and direct the flowing air to the rotor blades. To obtain higher delivery pressures, a number of such rotors, mounted on the same shaft, can be installed one behind the other in series, whereby the desired high pressure is achieved in several successive stages.

This new turbo-compressor air supply system enables air to be delivered at high pressures for subsequent use in a paint spray system or the like. The turbo-compressor includes a housing and a rotatable, vertically-disposed drive shaft centrally disposed within the housing, and a bearing housing which houses a concentrically disposed bearing. The system includes a rotatable section centrally disposed about the drive shaft. The section includes a first rotor and a second rotor. Each rotor comprises a series of blades spirally arrayed about the center of the shaft. The blades are sandwiched between a pair of plates. The rotors are rotatably driven in the same direction as the shaft, as the air is directed onto and through the blades. The rotors are coaxial with the shaft. The rotatable section also includes a tubular sleeve which is mounted about the shaft. The sleeve separate the rotors, and the sleeve is rotatable with the rotors and the shaft in the same direction as the rotors and the shaft.

The turbo-compressor also includes a stationary section, which is centrally disposed about the shaft. The stationary section includes a first stator and may also include successive stators. Each stator comprises a series of vanes spirally arrayed around the center of the central passage. The stator vanes are sandwiched between a pair of stator plates, the vanes directing the air flow from one rotor to the next. The stator is coaxial with the shaft. The stationary section also includes a ring which is mounted between the stators, and which separates the stators. The air is preferably fed into the top of the turbo-compressor and exits through the bottom thereof.

The turbo-compressor has several stages, each stage consisting of a rotor and a stator. However, the last stage preferably consists of a rotor only, and no stator. The rotor in the first stage is separated from the rotor in the second stage by the tubular sleeve. If the turbo-compressor has more than one stator, the stator in the first stage is separated from the stator in the second stage by the ring. Preferably, each rotor and each stator are alternatively disposed about the shaft.

As the drive motor is energized, the drive shaft rotates within the turbo-compressor. The rotation of the drive shaft, combined with the air being forced through the air-intake side of the first rotor cause the rotation of the rotor. Air is provided to the top of a turbo-compressor through the housing. The air leaves the first rotor and is guided inwardly into a second rotor by the vanes of the first stator, the first stator being centrally disposed about the shaft. The air circulates through the stator vanes which are spirally arrayed about the shaft.

For a more complete understanding of the multi-stage turbo-compressor of the present invention, reference is made to the following detailed description and accompanying drawings in which the presently preferred embodiment of the invention is illustrated by way of example. It is expressly understood, however, that the drawings are for purposes of illustration and description only, and are not intended as a definition of the limits of the invention. Throughout the following description and drawings, identical reference numbers refer to the same component throughout shown in the multiple drawings of the invention.

DETAILED DESCRIPTION OF THE INVENTION

The turbo-compressor air supply system of the present invention 10 includes a turbo-compressor 12, and delivers air to a paint spray system or the like at an elevated pressure.

Figure 1:
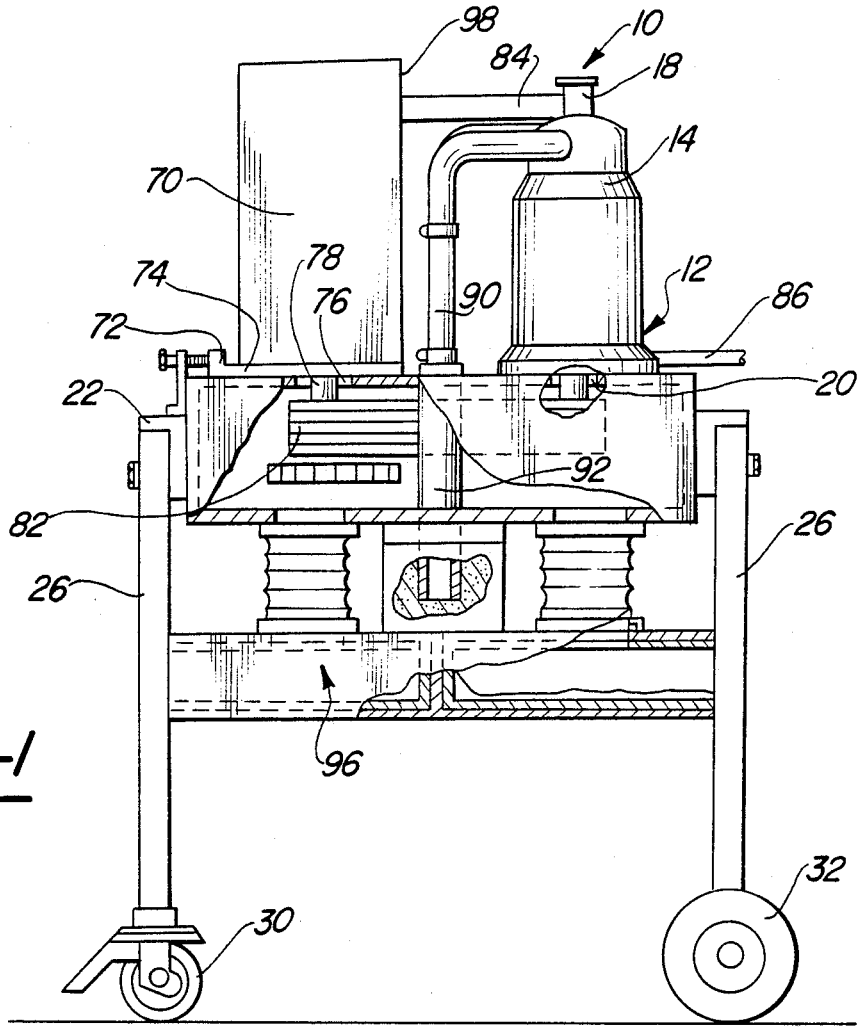
FIG. 1 is a side elevational view, with certain parts shown in section, of the turbo-compressor as used in a portable unit for a paint spray system.
Figure 2:
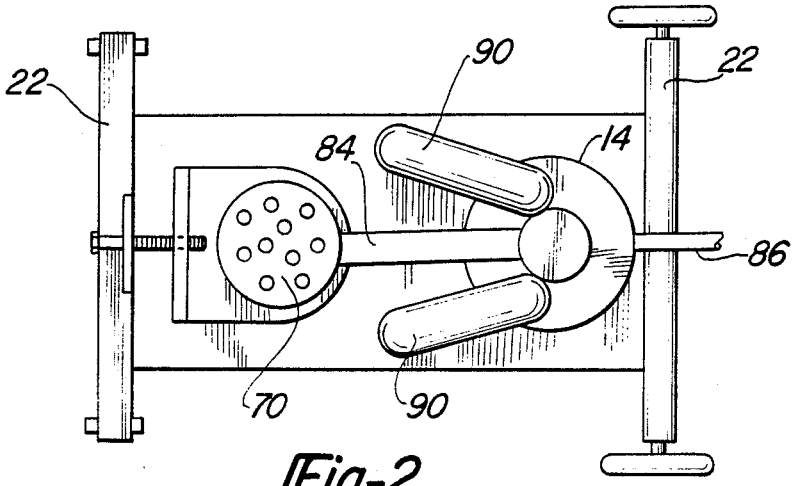
FIG. 2 is a copy view of the apparatus shown in FIG. 1.

Referring to FIG. 1 and 2, the turbo-compressor 12 is part of a portable paint spray unit, and includes a housing 14 and a rotatable, a vertically-disposed drive shaft 16 centrally disposed within the housing 14 is hollow and box-like having cross frame members 22 fixedly secured to the opposite ends of the housing 14, and projecting outwardly beyond the opposite sides of the box as shown in FIG. 2. From the ends of each cross frame member, vertical legs 26 project downward, one set of legs having caster 30 mounted wheels mounted at the lower end, while the other set of legs rotatably carries a somewhat larger, non-steerable set of wheels 32.

Figure 3:
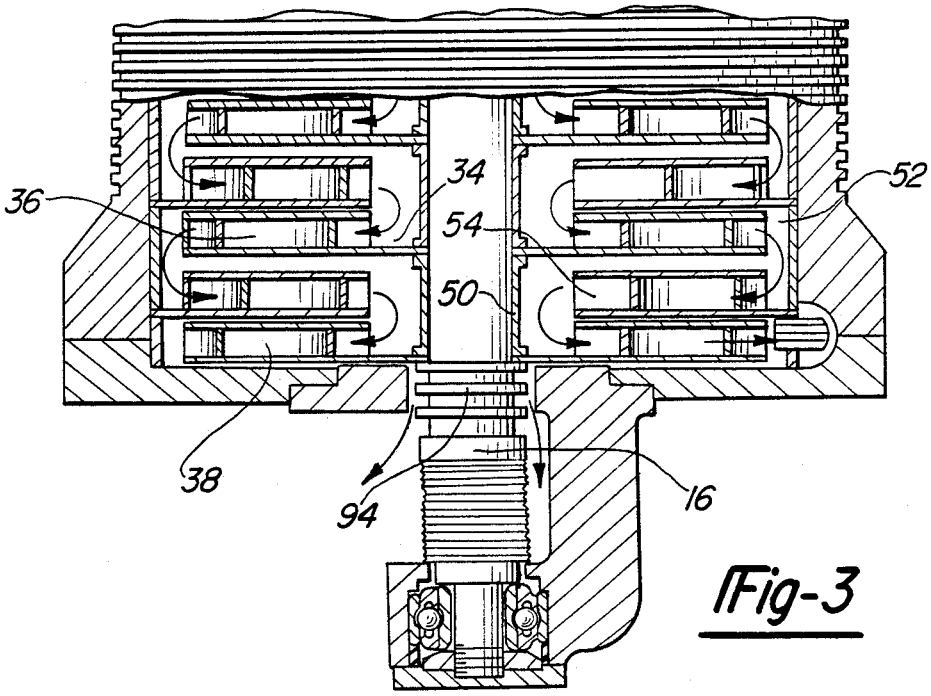
FIG. 3 is a detailed cross-sectional view of the rotors and stators of the turbo-compressor of the present invention.
Figure 4:
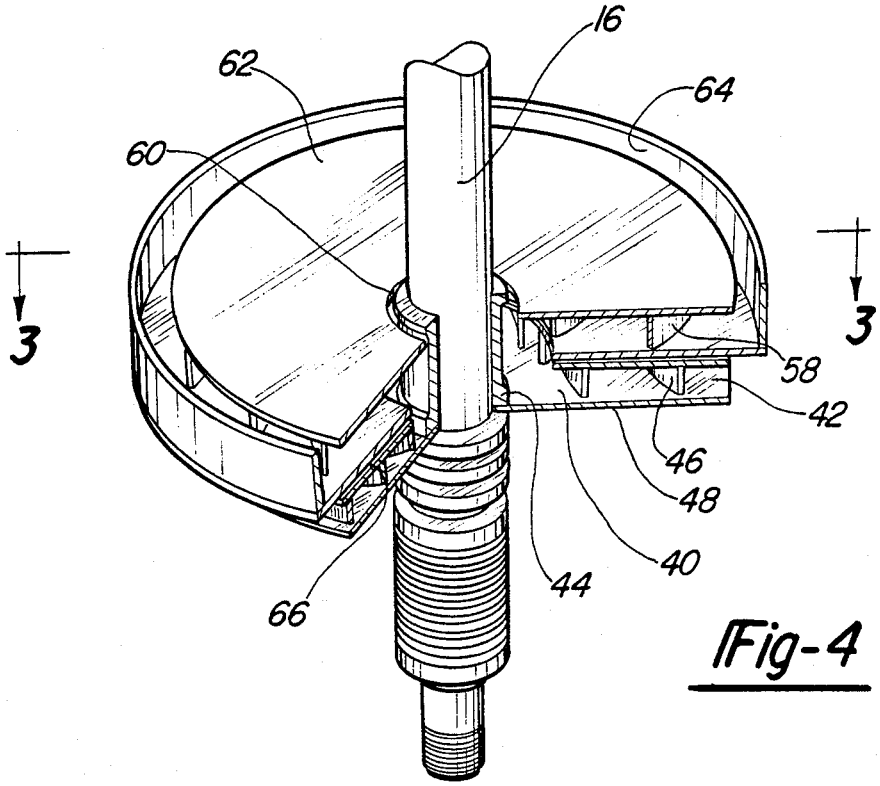
FIG. 4 is a detailed perspective view depicting the rotors and stators of the air supply system shown in FIG. 3.

The air supply system 10 in FIG. 1 includes a rotatable section 34 centrally disposed about the drive shaft 16 in FIG. 3 & 4. The section has a first rotor 36 and a second rotor 38. Each rotor 36 and 38 has an air-inlet side 40 and an air-outlet side 42, and a central passage 44. Each rotor 36 and 38 comprises a series of blades 46 spirally arrayed about the passage 44. The blades 46 are sandwiched between a pair of plates 48. The rotors 36 and 38 are rotatably driven in the same direction as the drive shaft 16, as the air is directed onto and through the blades 46. The rotors 36 and 38 are coaxial with the shaft 16. The rotatable section 34 also includes a tubular sleeve 50 which is mounted about the drive shaft 16. The tubular sleeve 50 separates the rotors, and the sleeve 50 is rotatable with the rotors 36 and 38 and the drive shaft 16 in the same direction as the rotors and the drive shaft 16.

The turbo-compressor 12 also includes a stationary section 52, which is also centrally disposed about the drive shaft 16. The stationary section 52 includes a stator 54, which includes a series of vanes 58 spirally arrayed around the center of a central stator passage 60. The vanes 58 are sandwiched between a pair of of stator plates 62. The stators 52 and 54 are coaxial with the drive shaft 16. If the turbo-compressor includes successive stators, each pair of adjacent stators 52 are separated by a ring 64, which is mounted between the stators 52. The diameter of the ring 64 is considerably larger than the diameter of the tubular sleeve 50. The air is preferably fed into an air inlet 84 at the top of the turbo-compressor 12 and exits through an air outlet 86 at the bottom thereof.

A combination of a rotor 36 with a stator 54 comprises a stage of the turbo-compressor 12. The turbo-compressor 12 consists of several stages 66, each of which has a rotor 36 and a stator 54. The air enters the turbo-compressor 12 through an air inlet 84 located at the top of the drive shaft 16 and exits the turbo-compressor housing 14. Preferably, the last stage at the bottom of the turbo-compressor 12 consists only of a rotor 36, since the outlet to the paint spray is in the housing 14. The rotor in the first stage 36 is separated from the rotor in the second stage 38 by the tubular sleeve 50. The stator in the first stage 54 is separated from the stator in the second stage 56 by the ring 64. Preferably, each rotor and each stator are alternately disposed about the drive shaft 16.

As shown in FIG. 1 a drive motor 70 is mounted upon a plate 72, which is slidable relative to the top wall 74 of the housing 14. The multi-stage turbo-compressor 12 is fixedly mounted upon the top wall 74 with the drive shaft 16 projecting downward through an opening 76 in the top wall 74. Rotation of the shaft 78 of the drive motor 70 is transmitted to the drive shaft 16 of the turbo-compressor 12 by a belt and a pulley drive 82 located within the unit.

FIG. 3 depicts a cross-sectional view of the turbo-compressor 12 with arrows indicating the direction of air flow. As the drive motor 70 is energized, the motor shaft 78 drives the shaft 16, which rotates within the turbo-compressor 12. The rotation of the drive shaft 16 combined with the air flow being directed into the air-inlet side of the first rotor 40 causes the rotor 36 to rotate about the drive shaft 16. Air is provided to the top of a turbo-compressor 12 through the housing 14 in FIG. 1.

As the air fills the housing 14, it is flung outwardly by the centrifugal force of the rotor 36. Air flowing into the inlet 84 at the upper end of the turbo-compressor 12 is accelerated and is increasingly compressed in successive stages 66. The vanes of the first stator 58 guide the air leaving the air-outlet side of the first rotor 42 to the air-inlet side of the second rotor 40. The guided air impinges upon the blades 46 of each rotor, and then is driven by each rotor around the drive shaft 16 at an increasing speed. The air is increasingly pressurized and accelerated as it leaves each successive rotor. As the air flows downwardly through the turbo-compressor 12, it is withdrawn therefrom into the outlet 86 which is in fluid communication with the paint spray gun or the like (note shown).

A pair of open ended vertically disposed tubular pipes 92 project vertically through the housing 14 and are fixedly secured within tightly fitted openings in the top wall 74 and the bottom wall of the housing. A flexible wall tube 90 is clamped to the upper end of each pipe 92 to connect the pipes to the extensions of the air inlet 84 to the turbo-compressor 12.

The lower bearing 20 is located at the end of the shaft 16 below the drive pulley. The opening formed around the series of flanges 94 on the drive shaft is held tight enough to restrict air losses and prevent damage to the internal rotating parts in the event of a failure of the lower bearing.

The lowermost tubular sleeve 50 rests on the topmost flange 94. The compressing of the air as it passes through the turbo-compressor 12 also heats the air, raising the air temperature about 130°-180° F. above the ambient temperature of the air entering the turbo-compressor 12.

To accommodate the flow of air while at the same time suppressing the noise existing in this chamber, a noise suppressor 96 is suspended below the housing 14. By diverting some of the air through the motor casing 98 around the bearing housing 18, a further cooling effect is achieved. The noise created by the drive shaft 16 and the lower bearing 20 in the event of a bearing failure, signals the operator to shut down the unit.

While the multi-stage turbo-compressor have been described in conjunction with a specific embodiment, it is evident that many alternatives, modifications, and variations will be apparent to those skilled in the art in light of the disclosure herein. It is intended that all such alternatives, modifications, and variations are included herein that fall within the spirit and scope of the appended claims.

I claim:

1. A turbo-compressor air supply system which supplies air to a paint spray system at an elevated pressure, the turbo-compressor includes a housing, a rotatable vertically-disposed drive shaft centrally disposed within the housing, a bearing housing which houses a concentrically disposed bearing, the drive shaft including a series of flanges disposed below the housing, the system comprising:

(a) a rotatable section centrally disposed about the shaft, the section including a first rotor and a second rotor, each rotor having a central passage for mounting about the shaft, each rotor having an air-inlet side and an air-outlet side, each rotor comprising a first series of blades spirally arrayed about the central passage, the first series of blades being sandwiched between a first pair of plates, the rotors being rotatably driven in the same direction as the shaft as the air is directed onto the blades, and the rotors being coaxial with the shaft, and the rotatable section also including a tubular sleeve which mounted about the shaft, the tubular sleeve separating the rotor, and the tubular sleeve being rotatable with the rotors and the shaft in the same direction as the rotors and the shaft, the air being expelled from the second rotor and circulated through the paint spray gun; and (b) a stationary section centrally disposed about the shaft, the stationary section including a first stator, the stator having a central passage for mounting about the shaft, the stator comprising a series of vanes spirally arrayed around the stator central passage, the stator vanes being sandwiched between a pair of stator plates, the stator being coaxial with the shaft, the vanes of the stationary section guiding the air leaving the air-outlet side of the first rotor to the air-inlet side of the second rotor;

whereby, some of the circulated air being expelled from the turbo-compressor is diverted through the flanges on the drive shaft and across the plane bearing.

2. The turbo-compressor of claim 1, wherein the stationary section includes a second stator, the second stator being similar to the first stator, the stationary section including a ring which is mounted between and separating the first stator and the second stator.

3. The turbo-compressor of claim 1, wherein air enters through the top of the turbo-compressor and exits through the bottom thereof.

4. The turbo-compressor of claim 1, further comprising a noise suppressor disposed beneath the plane bearing to reduce the noise generated by the flow of air through the turbo-compressor.

5. A method of supplying air through a turbo-compressor at an elevated pressure, the turbo-compressor including a housing, a rotatable vertically-disposed drive shaft centrally disposed within the housing, a bearing housing which houses a concentrically disposed bearing, the drive shaft including a series of flanges disposed below the housing, the method comprising:

(a) rotating a centrally disposed drive shaft within the housing of a turbo-compressor, the drive shaft having a first rotor disposed thereabout, the rotor being rotatable about the shaft, the rotor having a series of blades sandwiched between two plates, the blades being spirally arrayed from the center of the rotor, the rotor having an air-inlet side and an air-outlet side:

(b) providing air to the top of a turbo-compressor and into fluid communication with the air-inlet side of the first rotor:

(c) guiding the air into the air-inlet side of a second rotor by a stator which is centrally disposed about the shaft, the stator having a series of blades sandwiched between two plates, the air circulating through the blades which are spirally arrayed about the shaft;

(d) driving a second rotor about the shaft with the circulated air, the second rotor being separated from the first rotor by a tubular sleeve which is centrally disposed about the shaft, the air being increasingly pressurized and accelerated as it leaves the second rotor;

(e) withdrawing the pressurized air from the turbo-compressor, and supplying some of the air to a paint spray system which is in fluid communication with the base of the turbo-compressor and supplying the rest of the air being discharged from the turbo-compressor through the flanges on the drive shaft and across the plane bearing.

6. The method of claim 5, further comprising redirecting the pressurized air leaving the second rotor by a second stator, the first stator and the second stator being separated by a ring which is centrally disposed about the drive shaft, and the stators and the ring being stationary relative to the shaft and the rotors.

7. The method of claim 5, wherein each rotor and each stator are alternately disposed about the shaft.

8. The method of claim 7, wherein the air fills the housing and is flung outward by the centrifugal force of the rotor, and is forced between the blades of the rotor where it drives the rotor around at an increasing speed.

9. The method of claim 6, wherein the guided air impinges upon the blades of each rotor, and thereby driving each rotor around the shaft at an increasing speed.

10. A portable paint spray unit comprising:

(a) a drive motor having a drive shaft, the drive motor being disposed within a motor casing;

(b) a turbo-compressor including a housing mounted on the base, the turbo-compressor including a housing, and a rotatable vertically-disposed drive shaft centrally disposed within the housing, the turbo-compressor having a bearing housing which houses a concentrically disposed bearing, the drive shaft including a series of flanges disposed below the housing, the turbo-compressor having a drive shaft projecting from the housing into the chamber, the turbo-compressor having an air intake disposed at the top of the drive shaft, the turbo-compressor having an air outlet disposed at the bottom of the drive shaft, the air outlet being attachable to a paint spray system, the air outlet being in fluid communication with the chamber, some of the circulated air being discharged from the turbo-compressor being diverted through the flanges on the drive shaft and across the plane bearing;

(c) drive train means which couple the shaft of the drive motor to the drive shaft of the turbo-compressor;

(d) a noise suppressor being disposed beneath the turbo-compressor and the drive motor, the noise suppressor reducing the noise generated by the flow of air through the turbo-compressor.

* * * * *